US006772925B2

(12) United States Patent
O'Hare

(10) Patent No.: US 6,772,925 B2
(45) **Date of Patent: *Aug. 10, 2004**

(54) UNIVERSAL HUNTING PACK AND TURKEY HUNTING VEST

(76) Inventor: Daniel P. O'Hare, 1013 Mary Laidley Dr., Covington, KY (US) 41017

( * ) Notice: Subject to any disclaimer, the term of this patent is extended or adjusted under 35 U.S.C. 154(b) by 154 days.

This patent is subject to a terminal disclaimer.

(21) Appl. No.: 10/056,863

(22) Filed: Jan. 25, 2002

(65) Prior Publication Data

US 2002/0113103 A1 Aug. 22, 2002

Related U.S. Application Data

(63) Continuation-in-part of application No. 09/759,614, filed on Jan. 12, 2001.
(60) Provisional application No. 60/176,378, filed on Jan. 14, 2000.

(51) Int. Cl.[7] ..... A46F 4/02
(52) U.S. Cl. ..... 224/155; 224/156; 224/628; 224/652; 224/654; 224/658; 224/659; 297/129; 2/102
(58) Field of Search ..... 224/153, 155, 224/156, 627–630, 650, 652, 654, 655, 658, 659; 297/129; 190/127; 2/102

(56) References Cited

U.S. PATENT DOCUMENTS

| | | | | | |
|---|---|---|---|---|---|
| 3,622,056 | A | * | 11/1971 | Droeger | 224/153 |
| 3,730,294 | A | * | 5/1973 | Thurmond | 224/155 |
| 4,074,839 | A | * | 2/1978 | Wood et al. | 224/635 |
| 4,410,214 | A | * | 10/1983 | Geschwender | |
| 4,720,029 | A | * | 1/1988 | Varanakis | 224/155 |
| 4,809,893 | A | * | 3/1989 | Parsons | 224/261 |
| 4,925,064 | A | * | 5/1990 | Comora | 224/155 |
| 5,289,958 | A | * | 3/1994 | Jay | 225/155 |
| 5,439,153 | A | * | 8/1995 | Murdoch et al. | 150/159 |
| 5,465,425 | A | * | 11/1995 | Crispin | 2/102 |
| 5,560,524 | A | * | 10/1996 | Brune | 224/155 |
| 5,573,155 | A | * | 11/1996 | Sadler | 224/155 |
| 5,588,570 | A | * | 12/1996 | Zirbel | 224/155 |
| 5,620,227 | A | * | 4/1997 | Brune | 224/155 |
| 5,779,121 | A | * | 7/1998 | Capwell | 224/655 |
| 5,819,999 | A | * | 10/1998 | Tennant | 224/153 |
| 5,988,465 | A | * | 11/1999 | Vitale et al. | 224/155 |
| 6,036,067 | A | * | 3/2000 | Alcorn | 206/315.11 |
| 6,145,716 | A | * | 11/2000 | Caicedo | 224/155 |
| 6,161,739 | A | * | 12/2000 | Bentzen | 224/153 |
| 6,256,791 | B1 | * | 7/2001 | Callahan | 2/102 |
| 6,547,110 | B2 | * | 4/2003 | O'Hare | 224/155 |

FOREIGN PATENT DOCUMENTS

| | | | | |
|---|---|---|---|---|
| AT | 149560 | * | 5/1937 | 224/210 |
| FR | 942623 | * | 5/1949 | 224/210 |
| FR | 1354399 | * | 1/1964 | 224/210 |
| FR | 2579875 A | * | 10/1986 | 224/209 |
| NO | 71207 | * | 1/1994 | 224/209 |

* cited by examiner

*Primary Examiner*—Nathan J. Newhouse
(74) *Attorney, Agent, or Firm*—Wood, Herron & Evans, LLP

(57) ABSTRACT

A hunting pack or vest comprises an internal, angled frame for supporting a seated hunter wearing the vest. A cover proves free-floating pockets for the frame and a cargo pocket is disposed on the back of the cover over a rearwardly extending frame component. A seat is hinged at a juncture of the frame for stowed disposition under the cargo pocket and for deployed disposition extending forwardly of the frame. Angled pockets on the sides of the cargo pockets are accessible by a hunter wearing the pack whether standing or sitting. An orange panel is concealable, yet deployable over the cargo pocket. Two side vest panels are mounted forwardly of the cover and contain a plurality of ergonomically positioned pockets for easy accesses. Shoulder, waist and panel straps provide adjustment for varied sized and shaped hunters wearing a variety of clothing.

17 Claims, 5 Drawing Sheets

UNIVERSAL HUNTING PACK AND TURKEY HUNTING VEST

This application is a continuation in part of prior application Ser. No. 09/759,614 filed Jan. 12, 2001 and entitled "UNIVERSAL BACKPACK" AND LOUNGE SEAT COMBINATION" which application is expressly incorporated herein by reference, and which application itself is entitled to benefit of the filing date of provisional patent application Serial No. 60/176,378 filed Jan. 14, 2000. That provisional patent application is also expressly incorporated herein by reference. This invention relates to packs and vests for hunting and more particularly to vests for turkey hunting.

BACKGROUND OF THE INVENTION

Turkey hunters require a vest-like garment that has specially designed pockets to store all types of turkey calls (slate call, slate striker, box calls, mouth calls, plunger calls, etc.) along with other gear, such as a camouflage face mask, camouflage gloves, camera, decoys, etc. The disposition o the storage pockets for these various items is frequently less than optimum in typical vests and hunter access to his accessories while wearing the vest is difficult or awkward.

Traditionally, when using the traditional turkey vest for storing and carrying these items to and from the field, turkey hunters will also bring a soft pad seat cushion or stool to sit on while leaning against a tree or stump. Such pad or seat is usually carried in addition to any vest used, weapon or the like and is a transport nuisance.

Moreover, the hunter must usually find a tree, stump or fence post on which to lean while awaiting a wary turkey. Without such a prop, he quickly becomes uncomfortable and prone to movement which alerts or frightens away the game.

Also, when a turkey is harvested, it must be transported out of the woods. Carrying a turkey through the woods is dangerous; another hunter may shoot at it. Also, it is sometimes difficult to secure the turkey in the vest. When it is placed there, blood can leak out and ruin the vest, the hunter's clothes or his vehicle.

Prior turkey hunting vests thus leave a significant opportunity to focus on still further improvements stemming from the specific and unique needs of the turkey hunter.

It is thus one objective of the invention to provide a vest or pack for a turkey hunter which not only carries hunting accessories and harvested quarry, but provides the support necessary for comfortable, long term positioning without need of a prop.

It is a further desired objective of the invention to provide an improve turkey vest or pack suited for the complete need of the turkey hunter, facilitating transport of accessories and eliminating the need to carry a pad or chair separately.

It is another objective of the invention to provide the hunter with easy and ergonomic access to his/her game calls or accessories given the placement of the vest or pack components.

A further objective of the invention is to provide vest or pack apparatus for safely transporting a dead turkey and for capturing the blood from the bird without ruining the vest or other clothes.

A further objective of the invention is to provide a turkey vest or pack which can easily be opened to accommodate such a large bird, but can be easily closed to hold the bird in place.

A further objective of the invention is to improve the safety of a hunter when in the woods, both when carrying a harvested turkey and when hunting or moving about before a bird is harvested.

SUMMARY OF THE INVENTION

To these ends, the present invention contemplates a combined hunting vest or pack seat combination and which has an internal frame supporting the hunter in a sitting position without use of an extraneous structure such as a tree or fence post.

Preferably and according to the invention, a vest or pack comprises a cover or envelope over an internal support frame having a rearwardly inclined upper frame component and a lower rearwardly extending frame component at an angle to the upper frame component. These frame components free float in the cover and are removable for storage, if desired. A large cargo pocket is secured to the cover proximate the upper frame component and above the lower frame component. A seat pad is hinged to the cover proximate the juncture of the upper and lower frame components. In a stowed position, it is secured under the lower frame component, extending rearwardly from the wearer. When released, it can be swung under the frame to extend forwardly when the wearer wishes to sit on the ground, supported by the pad, all without removing the vest or pack. Two accessory pockets are secured to the outer sides of the cargo pocket. These are angled forwardly and upwardly for access by a wearer. Adjustable shoulder straps support the vest or pack on a hunter while a waist belt forwardly of the frame helps to distribute the vest weight over the hips.

In a more specific embodiment, the vest is provided with a plurality of additional ergonomically oriented pockets and the cargo pocket comprises a game transport pouch. The seat pad is attached to the cover or envelope surrounding the frame at its angled juncture and can be swung under the hunter as seating pad, while he leans backward against the vest and is supported by its internal frame. The hunter's back is thus comfortably supported in sitting condition, while the pad provides deployable seating comfort. More specifically, side panels extend forwardly of the frame from the cover, secured by a belt about the waste of a hunter. Multiple storage pockets are oriented on and in the side panels on angles for turkey hunting game calls.

For example, pockets are sewn into and configured into the vest panels. Box call sleeves, slate call pockets, striker sleeves and a side angled pocket with buckle flaps are all located ergonomically on the vest as will be described. Mouth call and other pockets are located on the internal sides of the panels for easy access.

A snap out blood bowl for capturing the blood of the harvested game is removably disposed within a game pocket secured to the cover on the backside of the vest above the lower frame component. The bowl is large enough to accommodate most harvested turkeys and is of blood-proof material to prevent soiling of the outer vest, clothing or the like.

According to the invention, in one embodiment, the combined turkey hunting vest or pack uses an internal frame. such as described in U.S. Pat. Nos. 4,208,070; 4,410,214 and U.S. Pat. Des. No. 259,752, which are expressly incorporated herein by reference as if fully set forth herein.

Beyond the internal frame having upper and lower frame components joining frame mandrels, the cover over them and the large rear cargo pocket, the vest includes other unique features according to more specific embodiments of the invention. One feature is the front panels that support the multiple game calls and other hunting articles that the turkey hunter carries. The panels support several pockets specific to turkey hunter's needs. One panel includes a box call sleeve that is on an angle to allow for the box call to slide in and out easily with elastic at the top of the sleeve so that the call will stay in place when leaning over. There are one or more additional pockets with zippers of two sizes to support the plunger call.

Additionally, on the top both panels is an angled on-seam zipper which allows for storage of accessory items such as face mask, gloves and other calls in the panels. Of note is the angle of the zippers, which are ergonomically designed for an easy and natural pull. On the inside of the panels, there are different sizes of mouth call pouches. These pouches have elastic at the top and are small mouthed to allow access, yet retain the calls. Other angled pockets and shell holders can be provided on the interior and exterior sides of the panels.

All pockets are of preferably the same material as the envelope, rugged and of camouflage finish. Preferably, the panels are secured to the cover by straps, adjustably held in releasable buckles to accommodate hunters of varying sizes.

The two front panels are joined to the frame cover by two respective sets of buckles and associated adjustment straps. These buckles are designed to be buckled or unbuckled at any given point, based on the preference of the user. The buckles also have adjustment straps to allow the user to make adjustment in size for large or small persons or to vary the size of the panels as desired with respect to the frame.

In addition to these adjustments, there are at least two other adjustments. A belt is positioned in the front of the two panels with a large buckle where the two panels come together, similar to a more traditional vest. The belt is adjustable. Also, shoulder straps are attached to the cover near the top of the upper frame component and to the tops of the panels at their forward ends. Each shoulder strap has an adjustment to increase or decrease the length of the vest, or its position on the hunter.

Lastly, as noted above, there are two side pockets sewn into each side of the vest game pocket that incorporate a buckle flap top to keep medium sized items in place.

In the rear, more specific embodiment of the vest, above the lower frame component, the cargo pocket comprises a game pouch is sewn onto the cover. An upper flap of the pouch or pocket is zippered for attachment of the upper end of the game pouch to the cover proximate the upper end of the frame member. A blood bowl is removably disposed in the game pouch. The bowl has four snaps to hold it in place and allows the bowl to be pulled out and cleaned. The material used is leakproof so that the blood does not leak through and soil the fabric of the lounge itself.

As noted, the game pouch has an upper outside flap provided with a zipper on its top to hold the flap in place, attached to the cover. The zipper also allows the flap to be pulled away to allow for easy loading and access of the game bird. Tucked down inside the cover and secured thereto is an orange flap that can be pulled out to cover the outside of the pocket or game pouch to visually protect the hunter from behind. The orange flap has two hook and loop fasteners on each comer to hold it in place. Alternately, the panel can be stored within the frame envelope at its upper end.

A wedge shaped seat cushion preferably of dense foam is incorporated into the seat pocket (attached to the cover at the frame juncture) to allow for comfortable sitting for extended periods of time. This wedge is slipped in place through the frame pocket which is, again, free floating on the frame. This foam is made of very dense material to keep from feeling the bumps, roots and rocks on the ground when seated. There is a clip at each end of the seat and at the cover near the end of the lower frame component to enable the seat to be clipped up and away from the user's legs, under the lower frame component, when walking.

Of course, one unique feature of the more specific embodiment of the vest herein is the angled internal frame with upper and lower frame components and the cover, providing seated support for the hunter. This combination is ergonomically designed to support the body in the upper shoulder and lateral area as well as the lower lumbar and buttock area in a seated position.

Overall, the basic vest construction comprising the frame, cover and cargo pockets, provides a comfortable, supportive and useful platform for a turkey hunter.

Moreover, the vest or pack of the invention provides unique advantages for turkey hunters. Ease of carrying specific calls and other gear, ease of transporting harvested birds safely, ease of sitting for long periods without needing to find a tree or fence post for back support, ease of positioning the vest and adjusting it to a specific hunter and ease of access to all gear pockets and receptacles are all provided.

These and other objectives and advantages will become readily apparent from the following detailed description and from the drawings in which.

Figure 1:
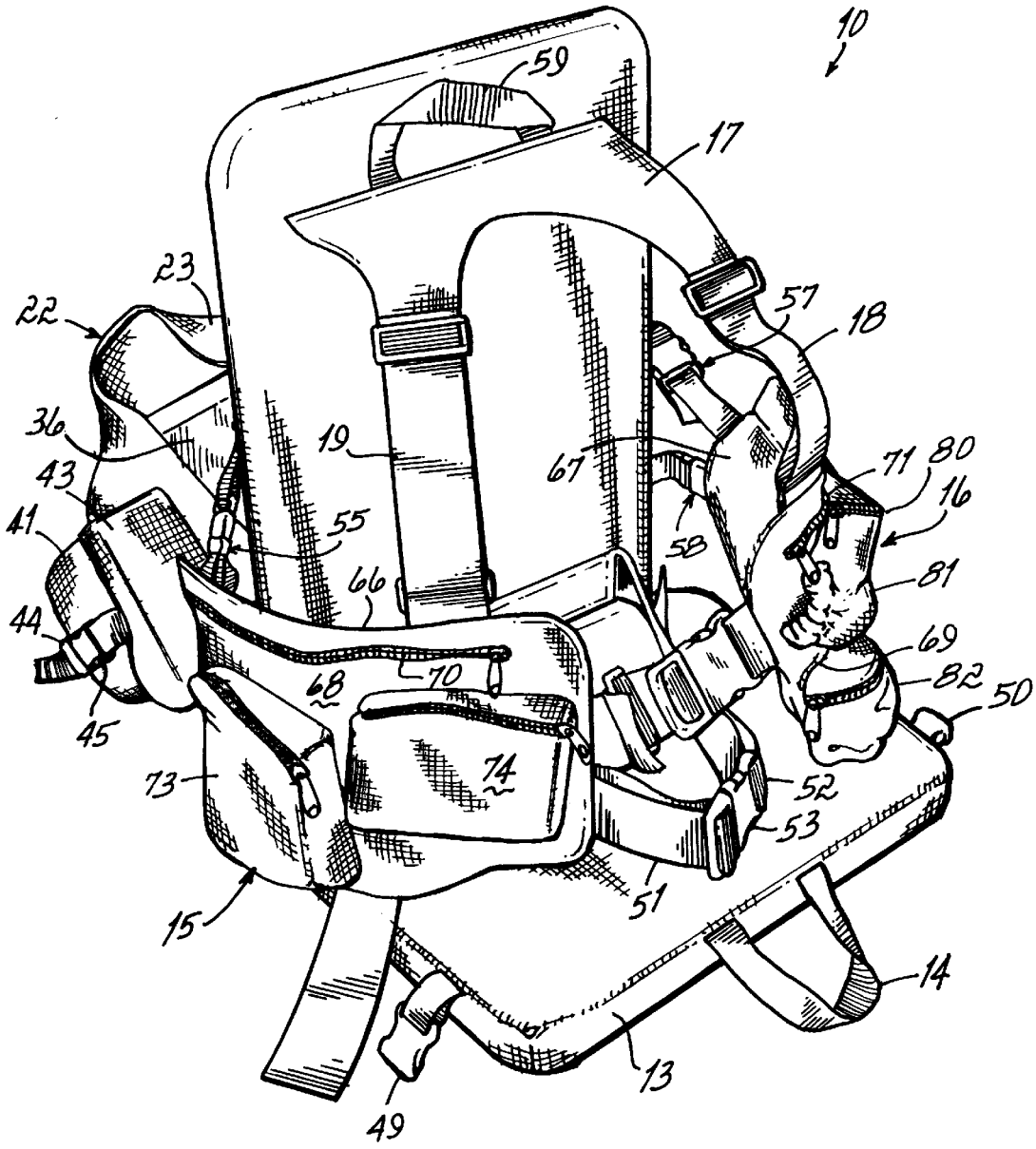
FIG. 1 is a front view of a turkey vest according to the invention.
Figure 2:
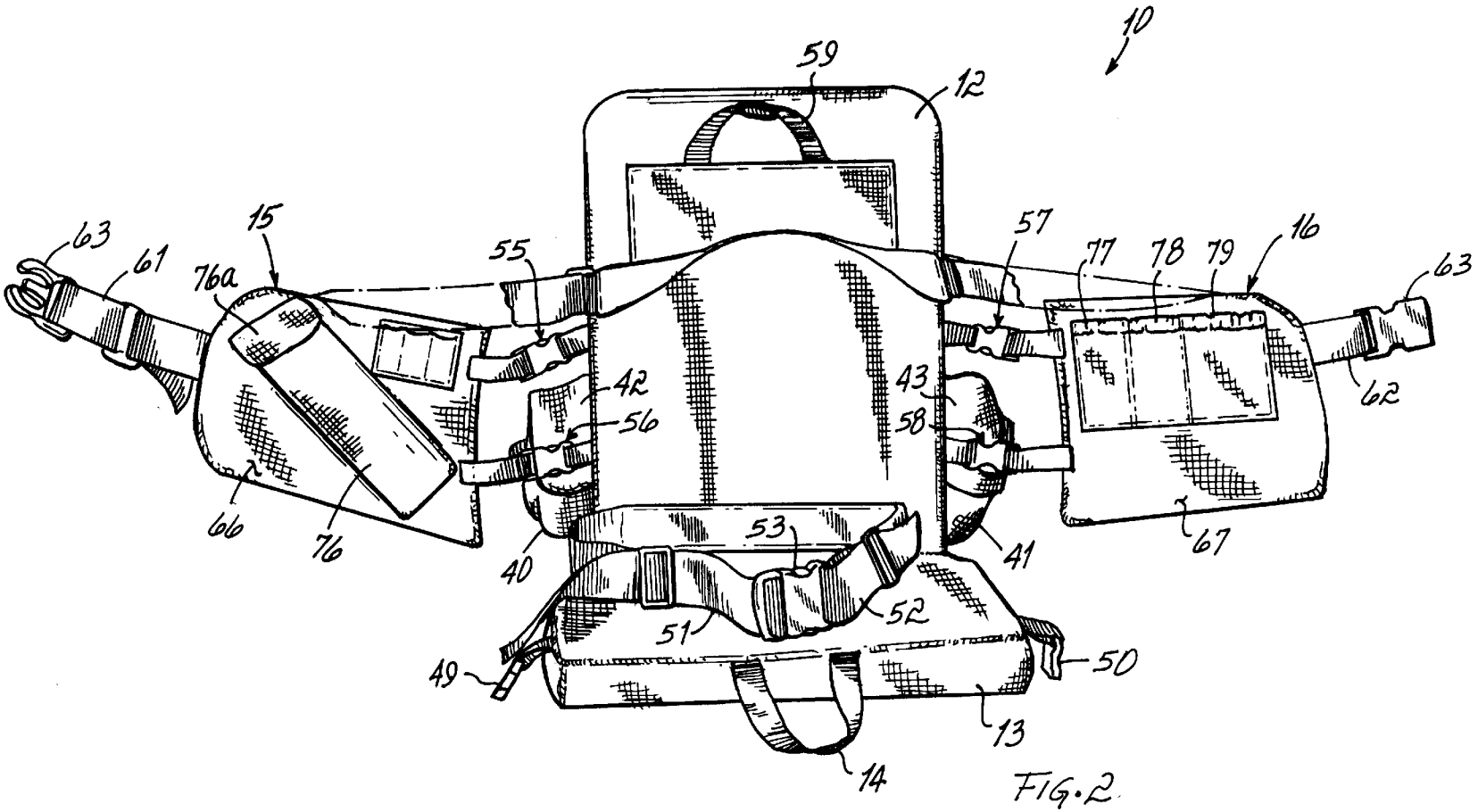
FIG. 2 is a front view of the vest of FIG. 1 with front panels rotated away from the seat for illustration.

Turning now to the drawings, there is shown in the Figs. a turkey hunting vest or pack 10 according to the invention.

A frame 11 supports a cover 12 comprising the fabric of the vest. Frame 11 has an upper frame component 11*a* and a lower frame component 11*b* extending rearwardly at an angle, preferably acute. Each frame component 11*a,* 11*b* is generally U-shaped. Preferably hollow, angled mandrels fit into the ends of the frame components to mount the frame components 11*a,* 11*b* together at an included angle preferably less than 90 degrees but more than 60 degrees, although any suitable angle will work. Frame 11 is like that frame described in U.S. patent application Ser. No. 09/759,614 filed Jan. 11, 2001 and expressly incorporated herein by reference.

Thus, it will be appreciated that the frame used in the vest/backpack 10 has an upper U-shaped component 11*a* parallel to the back of a user and a lower U-shaped component 11*b* at an angle to the back of the user extending rearwardly and under the body of portions of vest 10 as will be described. The lower U-shaped component 11*b* thus resides along the ground contour when the user is seated and the invention is used as a seat. It provides, in combination with the upper U-shaped component 11*a,* a back support, while the wearer is seated, without need of an extraneous support surface.

Other components of the specific embodiment of the vest include a padded seat 13 with pull loop 14, right and left panels 15, 16, shoulder yoke 17, adjustable shoulder straps 18, 19 and a game pocket 22. Panels 14, 16, shoulder yoke 17 and straps 18, 19 extend forwardly of frame 11 as viewed in the drawings, as does seat 13 when in position for use as a seat on the ground, for example. Carry strap 20 extends upwardly from yoke 17.

A cargo pocket comprising a game or turkey pocket 22 is sewn onto cover 12 at the frame 11 and has a rear flap 23 secured by a releasable fastener such as a zipper 24 to an upper portion of cover 12 near the upper end of frame component 11*a*.

A cover flap 26 extends from over the top end of upper frame component 11*a* downwardly toward flap 23 and releasable buckles 27, 28 secure cover flap 26 to the rear portion 29 of cover 12 around frame component 11*a* for strength and cover integrity.

Figure 4:
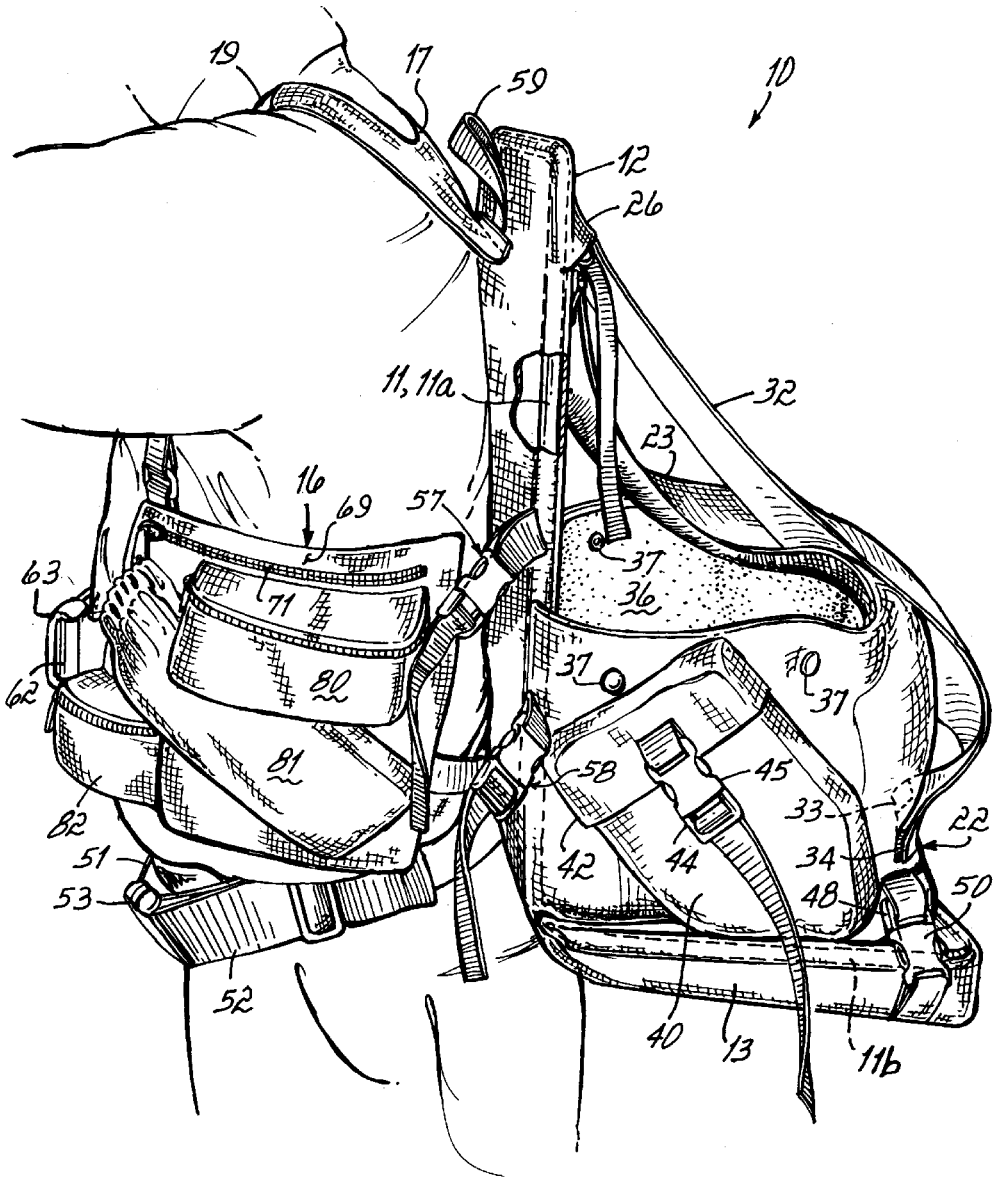
FIG. 4 is a view of the vest from its left side.
Figure 5:
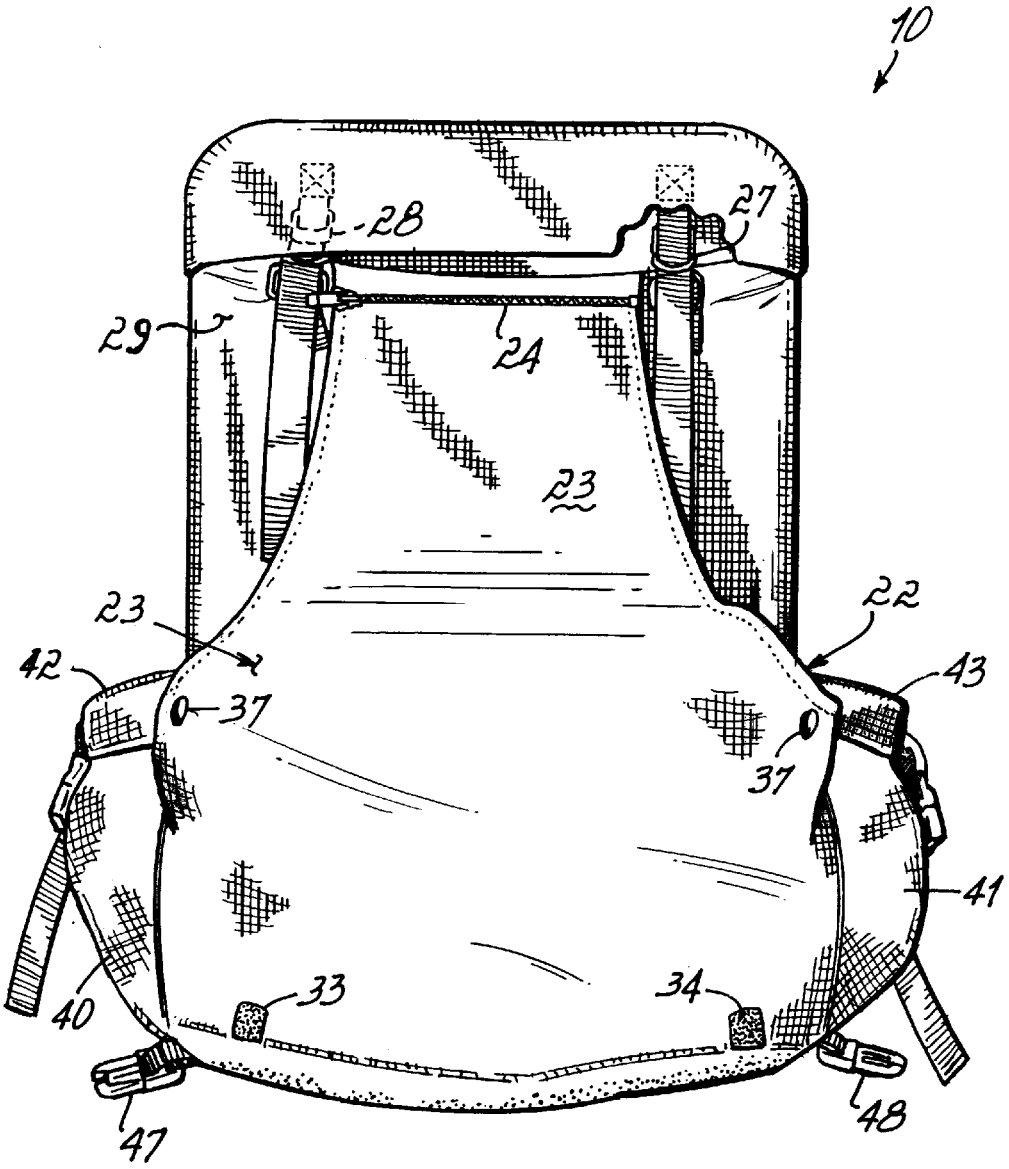
FIG. 5 is a rear view of the vest of FIG. 1.

Sewn into cover 12 is an orange panel 32. It is sewn to cover 12 proximate zipper 24. This panel can be stored within the cover where it is not desired to be seen. as when a hunter desires the upmost in camouflage. Alternately, it can be deployed as shown in FIG. 4 when its visibility is desired for safety. Two releasable fasteners 33, 34 such as hook and loop fasteners, hold the distal corners on to the lower portions of the game pocket 22 proximate the rearward end of lower frame component 11*b*.

A game pocket liner 36, of preferably any suitable waterproof or moisture-proof material, is held in pocket 22, preferably by releasable fasteners such as snaps 37. This liner is used to prevent blood or other substances from soiling the vest. It is removable for cleaning.

Figure 3:
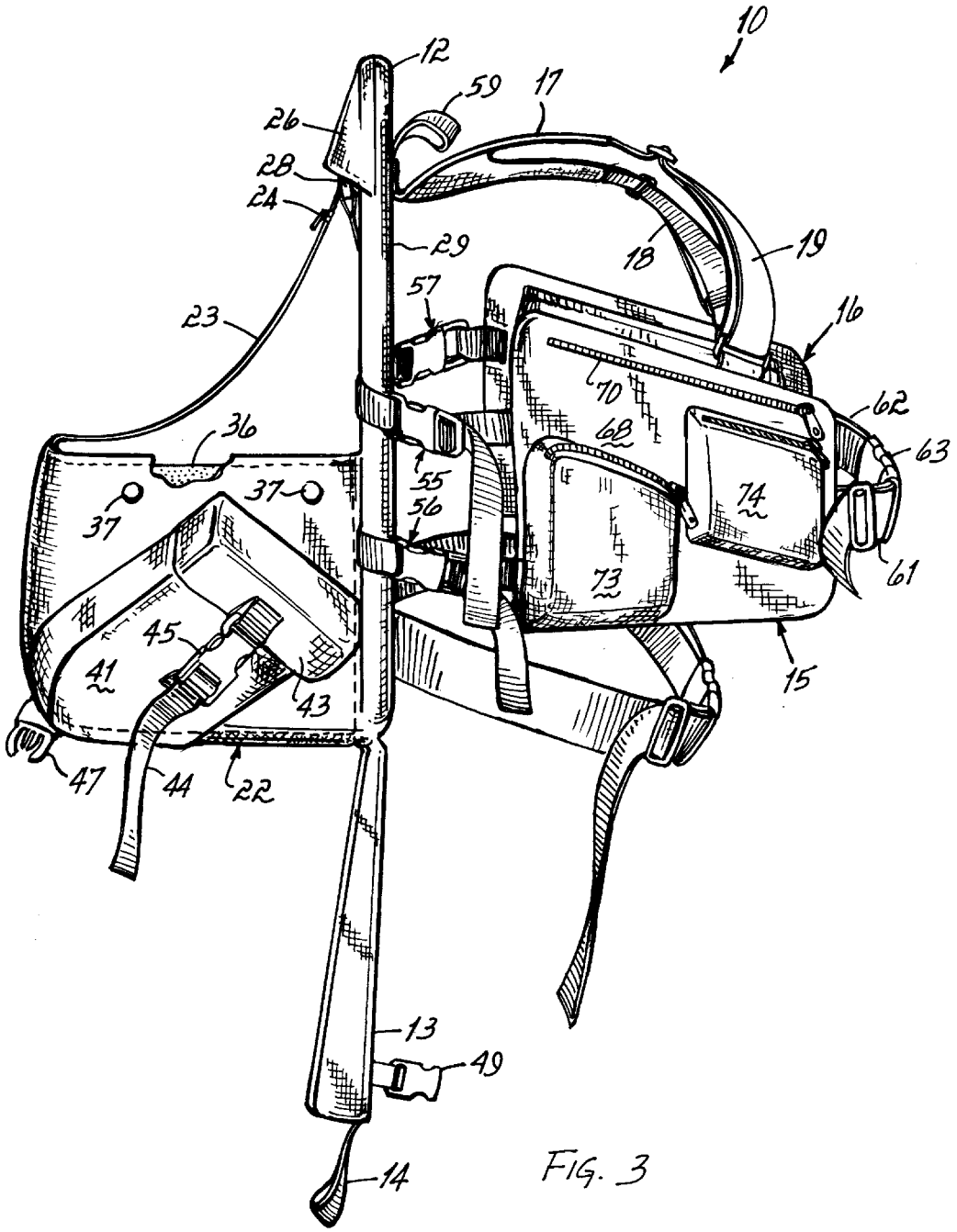
FIG. 3 is a view of the vest of FIG. 1 from its right side.

Thus, when game, such as a turkey, is harvested, zipper 24 is released and the bird placed in pocket 22. The zipper 24 is then closed so flap 23 secures the bird in the pocket and orange panel 32 deployed over the flap 23, for safety as the hunter returns from the field as shown in FIG. 3

Two angled pockets 40, 41 are disposed on the sides of pocket 22. These are angled as shown for easy access by the hunter wearing vest 10. Each pocket as a cap-shaped closure flap 42, 43 secured by adjustable straps and release buckles 44, 45 to secure variable items in pockets 40, 41.

Finally, at the rear of vest 10 are two buckle parts 47, 48 for cooperation with two compatible buckle parts 49, 50 on the padded seat 13. These parts are operable to secure the seat under the game pocket 22 and lower frame component 11*b* in a stored position when the hunter wearing the vest is moving about.

When a hunter desires to be seated, he releases the buckles formed by parts 47–50 and allows the seat 13 to rotate or hinge downwardly from its attachment to cover 12 at the juncture of frame components 11*a*, 11*b*. The hunter then grabs loop 14 and holds the padded seat 13 in place, forwardly of frame 11, as he sits.

Vest 10 further includes an adjustable waist belt 51, 52 with buckle 53 to help bear the weight of the vest on the hunter's hips.

Ends of belts 51, 52 are sewn or fixed securely to cover 12 proximate the juncture of frame components 11*a*, 11*b*.

Side panels 15, 16 are secured to cover 12 proximate upper frame component 11*a* by two respective sets of straps and buckle combinations 55, 56 and 57, 58. These are adjustable to vary the fit of the vest to the hunter wearing it, or the angle of the panels 15, 16 to the horizontal. It is preferred that the tops of panels 15, 16 angle downwardly from frame component 11*a* for ease of access to the pockets defined by and on the panels 15, 16 as will be described.

Shoulder yoke 17 is secured to the cover 12 proximate an upper portion thereof on frame component 11*a*. A loop 59 is secured to cover 12 near the yoke 17 to aid in carrying the vest when it is not worn.

The two adjustable should straps 18, 19 extend forwardly for the yoke to support panels 16, 15 respectively. These straps are also adjustable to length to accommodate hunters of widely varied size.

Belts 61, 62 are secured to the forward ends of panels 15, 16 to secure the panels, through buckle 63, together about the hunter.

Panels 15, 16 are each defined by inner and outer sides 66, 67 and 68, 69 respectively. Zippers 70, 71 in the panels define closeable openings in pockets between the sides 66, 68 in panel 15 and 67, 69 in panel 16. Since these zippers are generally parallel and proximate to the top edges of panels 15, 16, they are considered to be "on-seam"zippers which are angled downwardly, as are the top edges of the panels 15, 16 as shown . This greatly facilitates access to the pockets formed by the sides 66, 68 and 67, 69. These pockets can carry a variety of large cargo, food, equipment, clothing and the like.

The panels 15, 16 define or carry a plurality of other pockets and features particular to hunting and specifically turkey hunting. On panel 15, a small zippered pocket 73 has its zipper opening angled downwardly for easy access. Another pocket 74 is at the front of the panel for easy access. These pockets are useful, among other things, for a call. There is also an angled pocket 76 with a flap 76*a* at the forward end of the inside of the panel for strikers and the like. The angled orientation of the pocket facilitates striker access.

On the internal side 67 of panel 16, multiple pockets 77, 78, 79 are provided for mouth calls or the like. These have elasticized tops for securing the calls yet allowing easy access. Further, an outside 69 of panel 16, three additional pockets 80, 81, 82 are provided. Pocket 80 is zippered, as is pocket 82 and each are sized to hold specific turkey calls or other gear. Elongated pocket 81 has an elasticized mouth for securing long slate call strikers or the like.

With the exception of pocket 82, it will be appreciated that other pockets on the external sides of panels 15, 16 are disposed and oriented ergonomically so that access to the pocket openings is facilitated with respect to the hunter when he is wearing the vest 10. The downwardly angled zippered openings facilitate this, as do the upwardly and forwardly opening mouths of the flap covered or elasticized other pockets as described.

Moreover, the seat 13 is releasable from under the game pocket 22 and is easily deployed and comfortable, yet stows away when not in use so as not to interfere with a hunter.

It will also be appreciated that cover 12, and all pockets and other materials are preferably made of any suitable camouflage pattern. The belts and buckles described can be of sturdy well-known construction of black webbing and the buckles of well-known quick-release style of synthetic material.

Finally, it will be appreciated that the vest 10 is widely adjustable to fit a wide variety of hunters and to provide desirable positioning of the vest components on the hunter for comfort and easy access.

In use, a hunter dons the vest 10 by opening buckles 63 and 53. He slips the yoke 17 over his shoulders with the frame 11 at his back. The shoulder straps 18, 19 are adjusted to his size, shape and clothing, then belts 51, 52 are adjusted to his waist and closed by buckle 53. If the panels 15, 16 are positioned as desired, he then adjusts belts 61, 62 and closes buckle 63. Strap and buckle sets 55–58 can be adjusted also to help fit the panels to the proper position.

When at a hunting site, the hunter releases the seat 17, holds loop 14 while moving to a sitting position, and sits in a comfortable position, leaning back on the vest 10 and frame 11 which supports his back comfortably. Most, if not all, the pockets and the gear therein are readily accessible to him as he sits and hunts.

These and other modifications and advantages will become readily apparent to those of ordinary skill in the art without departing from the scope of this invention and the applicant intends to be bound only by the claims appended hereto.

What is claimed is:

1. A hunting pack comprising:

an internal frame having an upper frame component and a lower frame component, said frame components mounted together at a frame juncture on an acute angle;

a cover defining a pocket for said frame;

a cargo pocket disposed on said cover on one side of said upper frame component and above said lower frame component; and a seat hinged to said cover proximate said juncture;

said seat being stowable in one position under said lower frame component and extending in one direction and being moveable to a sitting position in a substantially opposite direction;

said frame providing back support for a seated wearer.

2. A hunting pack as in claim 1 further including two accessory pockets disposed on respective sides of said cargo pocket, said two accessory pockets inclined upwardly and toward said upper frame component and having openings at upper ends for access by a hunter wearing the pack from both a standing position and a sitting position.

3. A hunting pack as in claim 2 wherein said cargo pocket has an upper opening closed by a zipper operably attached proximate an upper portion of said upper frame component.

4. A hunting pack as in claim 1 further including a concealable orange panel attached to said hunting pack and being selectively deployable over said pocket.

5. A backpack for use by a user comprising, in combination:

a frame having respective upper and lower frame components disposed at an angle to each other, an envelope covering said frame components, a storage pocket disposed on one portion of said envelope covering an upper frame component and above another portion of said envelope covering said lower frame component, and a pivoting seat attached to another portion of said envelope proximate an apex of said angle, said seat being pivotal at least forwardly of said apex for sitting on by a user and said seat being pivotable beneath said lower frame component to a stored position when not in use and being latched in said storage position beneath said lower frame component.

6. A backpack for use by a user and comprising, in combination:

a frame having respective upper and lower frame components disposed at an angle to each other, an envelope covering said frame components, a storage pocket disposed on one portion of said envelope covering an upper frame component and above another portion of said envelope covering said lower frame component, and said storage pocket having one side defined by an outer side of said envelope covering an upper frame component and a bottom defined by an outer side of said envelope covering a lower frame component.

7. A backpack as in claim 6 wherein said storage pocket comprises two side portions having edges attached to said envelope along portions covering both upper and lower frame components, respectively, and a rear portion attached to a portion of said envelope covering said lower frame component.

8. A backpack as in claim 7 comprising a waist belt attached to a portion of said envelope covering said upper frame element.

9. A backpack as in claim 7 further comprising a seat pad hinged to said envelope proximate to an apex about which said upper and lower frame components are joined, and fasteners releasably holding said seat pad beneath said lower frame component, said seat being pivotable from beneath said lower frame component to extend forwardly of said upper frame component to provide a seat for a user wearing said backpack.

10. A backpack as in claim 7 further including at least one side pocket on one of said side portions of said storage pocket, said side pocket opening forwardly and upwardly toward said upper frame component and having a lower side proximate said lower frame component.

11. A backpack comprising a frame having respective U-shaped upper and lower frame components, said upper and lower components, when operably connected at a frame juncture, defining an angle therebetween, an envelope covering said frame components, and a pocket, said pocket defined by a portion of said envelope covering said upper frame component and said pocket having a bottom defined by a portion of said envelope covering said lower frame component, a seat hinged to said pocket proximate said frame juncture, said seat being stowable in one position under said lower frame component and extending in one direction and being moveable to a sitting position in a substantially opposite direction;

said frame providing back support for a seated wearer.

12. A backpack comprising:

a frame having upper and lower frame components joined at a frame juncture of an included angle of less than ninety degrees, an envelope covering said frame components;

a backpack pocket having pocket portions sewn to a portion of said envelope covering said upper frame component and pocket portions sewn to a portion of said envelope covering said lower frame component, a seat pad hingedly attached to said backpack proximate said frame juncture, said seat being stowable in one position under said lower frame component and extending in one direction and being moveable to a sitting position in a substantially opposite direction;

said frame providing back support for a seated wearer.

13. A backpack comprising:

a frame having upper and lower frame components; an envelope covering said frame components joined at a frame juncture of an included angle of less than ninety degrees;

a pocket sewn to said envelope proximate said upper frame component and to said envelope proximate said lower frame component, a seat pad hingedly attached to said backpack proximate said frame juncture, said seat being stowable in one position under said lower frame component and extending in one direction and being moveable to a sitting position in a substantially opposite direction;

said frame providing back support for a seated wearer.

14. A backpack comprising:

a frame having upper and lower frame components forming an included acute angle with each other at a frame component juncture, an envelope covering said frame components;

a pocket formed by a pocket panel sewn to respective portions of said envelope covering both said upper frame component and said lower frame component, a seat pad hingedly attached to said backpack proximate said frame component juncture, said seat being stowable in one position under said lower frame component and extending in one direction and being moveable to a sitting position in a substantially opposite direction;

said frame providing back support for a seated wearer.

15. A backpack comprising:

a frame having upper and lower frame components joined at a frame juncture of an included angle of less than ninety degrees;

an envelope covering said frame components, said envelope having upper and lower outer surfaces;

a pocket member sewn to said envelope along said envelope proximate both said upper and lower frame components, such that said upper outer surface of said envelope defines one interior side of said pocket and said lower outer surface of said envelope defines an interior bottom surface of said pocket, a seat pad hingedly attached to said backpack proximate said frame juncture, said seat being stowable in one position under said lower frame component and extending in one direction and being moveable to a sitting position in a substantially opposite direction;

said frame providing back support for a seated wearer.

16. A backpack for use by a user and comprising, in combination:

a frame having respective upper and lower frame components joined at an apex and disposed at an angle to each other, an envelope covering said frame components, a storage pocket disposed on one portion of said envelope covering an upper frame component and above another portion of said envelope covering said lower frame component, said storage pocket having one side defined by an outer side of said envelope covering an upper frame component and a bottom defined by an outer side of said envelope covering a lower frame component, and said backpack further comprising a seat pad hinged to said envelope proximate to said apex about which said upper and lower frame components are joined, and fasteners releasably holding said seat pad beneath said lower frame component, said seat being pivotable from beneath said lower frame component to extend forwardly of said upper frame component to provide a seat for a user wearing said backpack.

17. A backpack for use by a user and comprising, in combination:

a frame having respective upper and lower frame components disposed at an angle to each other, an envelope covering said frame components, a storage pocket disposed on one portion of said envelope covering an upper frame component and above another portion of said envelope covering said lower frame component, said storage pocket having one side defined by an outer side of said envelope covering an upper frame component and a bottom defined by an outer side of said envelope covering a lower frame component, wherein said storage pocket comprises two side portions having edges attached to said envelope along portions covering both upper and lower frame components, respectively, and a rear portion attached to a portion of said envelope covering said lower frame component, and further including at least one side pocket on one of said side portions of said storage pocket, said side pocket opening forwardly and upwardly toward said upper frame component and having a lower side proximate said lower frame component.

* * * * *